US011383901B2

(12) United States Patent
Niver

(10) Patent No.: US 11,383,901 B2
(45) Date of Patent: Jul. 12, 2022

(54) PRESSURE RELIEF CAP

(71) Applicant: Bemis Manufacturing Company, Sheboygan Falls, WI (US)

(72) Inventor: Michael Andrew Niver, Plymouth, WI (US)

(73) Assignee: Bemis Manufacturing Company, Sheboygan Falls, WI (US)

( * ) Notice: Subject to any disclaimer, the term of this patent is extended or adjusted under 35 U.S.C. 154(b) by 125 days.

(21) Appl. No.: 16/689,891

(22) Filed: Nov. 20, 2019

(65) Prior Publication Data

US 2020/0180830 A1 Jun. 11, 2020

Related U.S. Application Data

(60) Provisional application No. 62/775,564, filed on Dec. 5, 2018.

(51) Int. Cl.
*B65D 51/16* (2006.01)

(52) U.S. Cl.
CPC ..... *B65D 51/1644* (2013.01)

(58) Field of Classification Search
CPC ..... B65D 51/1644; B65D 51/1672; B65D 51/1683; B65D 41/04; B65D 55/022; F16K 24/04; F16K 17/04; F16K 17/168; F16K 17/02; B60K 2015/0432; B60K 2015/0451; B60K 2015/03296; B60K 2015/0438; B60K 2015/03547; B60K 15/04; B60K 15/0406; B60K 15/03519; Y10S 220/33; Y10S 220/32; Y10S 277/91; Y10S 277/921; B62J 35/00; B62J 99/00; B60Y 2200/12; F01P 11/0238; F02M 37/0076; F02M 25/089
USPC .... 220/203.01–203.27, 562, 694, 86.1–86.2, 220/89.1–89.4, 303–304, 203.26, 288, 220/203.2–203.21, 203.24, DIG. 32, 220/DIG. 33; 137/43; 141/301
See application file for complete search history.

(56) References Cited

U.S. PATENT DOCUMENTS 3,164,288 A * 1/1965 Boomgaard ..... F01P 11/0247 220/203.24
3,203,445 A * 8/1965 McCormick ..... F01P 11/0247 137/493.4

(Continued)

*Primary Examiner* — Chun Hoi Cheung
*Assistant Examiner* — Brijesh V. Patel
(74) *Attorney, Agent, or Firm* — Michael Best & Friedrich LLP

(57) ABSTRACT

A pressure relief cap includes a body engageable with a container and rotatable about an axis to couple or decouple the body from the container, a handle is coupled to the body and rotatable about the axis in a loosening direction and an opposite, tightening direction and, a ring member coupled for co-rotation with the handle in the loosening direction. The cap includes relief valve assembly coupled to the body. The ring member and the body include a lost motion region in which the ring member is rotatable relative to the body in the loosening direction. Rotation of the ring member relative to the body in the loosening direction in the lost motion region opens the relief valve assembly. Rotation of the ring member in the loosening direction beyond the lost motion region causes the body to co-rotate with the ring member in the loosening direction.

20 Claims, 7 Drawing Sheets

(56) References Cited

U.S. PATENT DOCUMENTS 4,271,976 A * 6/1981 Detwiler ..... F01P 11/0247 220/203.07
4,337,873 A * 7/1982 Johnson ..... B60K 15/0406 137/493.8
4,379,470 A * 4/1983 Reutter ..... F01P 11/0238 137/493.8
4,676,390 A 6/1987 Harris
4,765,505 A 8/1988 Harris
4,779,755 A 10/1988 Harris
4,785,961 A * 11/1988 Kasugai ..... B60K 15/0406 220/203.25
4,787,529 A * 11/1988 Harris ..... B60K 15/0406 137/43
4,830,058 A * 5/1989 Harris ..... B60K 15/0406 138/89
4,887,733 A 12/1989 Harris
4,913,303 A * 4/1990 Harris ..... B60K 15/0406 137/39
5,071,020 A * 12/1991 Reutter ..... B65D 51/1644 220/203.06
5,108,001 A 4/1992 Harris
5,110,003 A * 5/1992 MacWilliams .... B60K 15/0406 220/288
5,183,173 A * 2/1993 Heckman ..... B60K 15/0406 220/203.07
5,279,439 A * 1/1994 Kasugai ..... B60K 15/0406 137/526
5,449,086 A 9/1995 Harris
5,480,055 A 1/1996 Harris et al.
5,520,300 A 5/1996 Griffin
5,522,456 A * 6/1996 Valk ..... F01P 11/0247 165/104.32
5,540,347 A * 7/1996 Griffin ..... B60K 15/0406 137/493.1
5,638,975 A 6/1997 Harris
5,794,806 A * 8/1998 Harris ..... B60K 15/0406 220/203.24
5,829,620 A * 11/1998 Harris ..... B60K 15/0406 220/203.26
6,095,363 A * 8/2000 Harris ..... B60K 15/0406 220/203.24
6,260,726 B1 * 7/2001 Muth ..... B60K 15/0406 220/203.24
6,286,704 B1 * 9/2001 Harris ..... B60K 15/0406 220/295
6,796,451 B2 * 9/2004 Harris ..... F01P 11/0238 220/203.22
7,104,415 B2 * 9/2006 Reutter ..... F01P 11/0238 220/203.12
7,131,469 B2 11/2006 Dunkle
7,163,117 B2 * 1/2007 Griffin ..... B60K 15/0406 220/303
7,344,042 B2 * 3/2008 Hagano ..... B60K 15/0406 220/288
7,353,965 B2 * 4/2008 Reutter ..... B60K 15/0406 220/303
7,380,681 B2 * 6/2008 Reutter ..... F01P 11/0238 220/203.27
7,624,889 B2 * 12/2009 Tharp ..... B60K 15/0406 220/210
7,654,403 B2 * 2/2010 DeCapua ..... F16K 17/196 220/203.23
8,074,334 B2 12/2011 Tharp et al.
8,353,418 B2 * 1/2013 Bork ..... B65D 51/1683 220/203.26
8,567,628 B2 10/2013 Dunkle et al.
8,740,002 B2 * 6/2014 Ripberger, Jr. .... B60K 15/0406 220/295
9,688,135 B2 * 6/2017 Dunkle ..... B60K 15/03504
2003/0102314 A1 * 6/2003 Hagano ..... B60K 15/04 220/304
2003/0150859 A1 * 8/2003 Reutter ..... F02M 59/102 220/203.23
2016/0031616 A1 * 2/2016 Rye ..... B65D 51/1644 220/203.29
2016/0068061 A1 * 3/2016 Whelan ..... B60K 15/03519 220/203.23
2016/0185209 A1 * 6/2016 Ayers ..... B60K 15/0406 220/203.01
2017/0015194 A1 1/2017 Frank et al.
2019/0381880 A1 * 12/2019 Kamiyama ..... F02M 25/089

* cited by examiner

PRESSURE RELIEF CAP

CROSS REFERENCE TO RELATED APPLICATIONS

This application claims priority to U.S. Provisional Patent Application No. 62/775,564, filed Dec. 5, 2018, the entirety of which is hereby incorporated by reference.

FIELD

The present invention relates to caps for containers and, more particularly, to pressure relief caps.

BACKGROUND

When containers are sealed with a cap, a pressure difference may develop between the interior of the container and the surrounding atmosphere. For example, pressure within the container may increase or decrease in response to changes in temperature and/or changes in phase of the contents of the container. When the pressure within the container differs from the pressure of the surrounding atmosphere, it may become difficult to remove the cap. In addition, if the cap is removed, rapid pressure equalization may cause contents of the container to be expelled out of the container.

SUMMARY

The present disclosure may provide, in one independent aspect, a pressure relief cap configured to be coupled to a container. The pressure relief cap may include a body engageable with the container and rotatable about an axis to couple or decouple the body from the container, a handle coupled to the body and rotatable about the axis in a loosening direction and an opposite, tightening direction, and a ring member coupled for co-rotation with the handle in the loosening direction. The pressure relief cap may also include relief valve assembly coupled to the body. The ring member and the body may be configured with a lost motion region in which the ring member may be rotatable relative to the body in the loosening direction. Rotation of the ring member relative to the body in the loosening direction in the lost motion region may open the relief valve assembly, and rotation of the ring member in the loosening direction beyond the lost motion region may cause the body to co-rotate with the ring member in the loosening direction.

The pressure relief cap may also include a first biasing member coupled between the body and the ring member and configured to bias the ring member relative to the body in the tightening direction. The ring member may include a first rib, the body may include a second rib, and a first biasing member may be configured to bias the first rib into engagement with the second rib. Engagement of the first rib with the second rib may cause the body to co-rotate with the ring member in the tightening direction.

The ring member may include a third rib offset in a circumferential direction from the first rib, and the body may include a fourth rib offset in a circumferential direction from the second rib. Rotation of the handle in the loosening direction disengages the first rib and the second rib to allow the ring member to enter the lost motion region. When the ring member reaches the end of the lost motion region the third rib on the ring member engages with the fourth rib on the body to allow the body to co-rotate with the ring member and the handle.

A spacing between the first rib and the third rib may be less than a spacing between the second rib and the fourth rib. A difference between the spacing between the first rib and the third rib and the spacing between the second rib and the fourth rib may be about 45 degrees.

The relief valve assembly may include a plunger and a second biasing member operable to bias the plunger toward a sealed position. The ring member may include a cam-shaped actuator configured to move the plunger toward an unsealed position when the ring member rotates relative to the body in the loosening direction through the lost motion region.

The pressure relief cap may further include a ratchet assembly operable to permit the handle to rotate relative to the ring member in the tightening direction when torque applied to the handle in the tightening direction exceeds a predetermined torque threshold.

The present disclosure may provide, in another independent aspect, a pressure relief cap configured to be coupled to a container. The pressure relief cap may include a body engageable with the container and rotatable about an axis, a handle coupled to the body and rotatable about the axis in a loosening direction and a tightening direction, a ring member coupled for co-rotation with the handle in the loosening direction, and a relief valve assembly coupled to the body. The handle and the ring member may be rotatable relative to the body in the loosening direction from a first position to a second position. The relief valve assembly may be configured to open to vent the container in response to rotation of the handle and the ring member from the first position to the second position. The body may be configured to rotate in the loosening direction in response to further rotation of the handle and the ring member from the second position in the loosening direction.

Other independent aspects of the invention may become apparent by consideration of the detailed description and accompanying drawings.

Before any independent embodiments of the disclosure are explained in detail, it is to be understood that the disclosure is not limited in its application to the details of construction and the arrangement of components set forth in the following description or illustrated in the following drawings. The disclosure is capable of other independent embodiments and of being practiced or of being carried out in various ways. Also, it is to be understood that the phraseology and terminology used herein is for the purpose of description and should not be regarded as limiting.

Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof.

Also, the functionality described herein as being performed by one component may be performed by multiple components in a distributed manner. Likewise, functionality performed by multiple components may be consolidated and performed by a single component. Similarly, a component described as performing particular functionality may also perform additional functionality not described herein. For example, a device or structure that is "configured" in a certain way is configured in at least that way but may also be configured in ways that are not listed.

Relative terminology, such as, for example, "about", "approximately", "substantially", etc., used in connection with a quantity or condition would be understood by those of ordinary skill to be inclusive of the stated value and has the meaning dictated by the context (for example, the term includes at least the degree of error associated with the measurement of, tolerances (e.g., manufacturing, assembly, use) associated with the particular value, etc.). Such terminology should also be considered as disclosing the range defined by the absolute values of the two endpoints. For example, the expression "from about 2 to about 4" also discloses the range "from 2 to 4".

DETAILED DESCRIPTION

Figure 1:
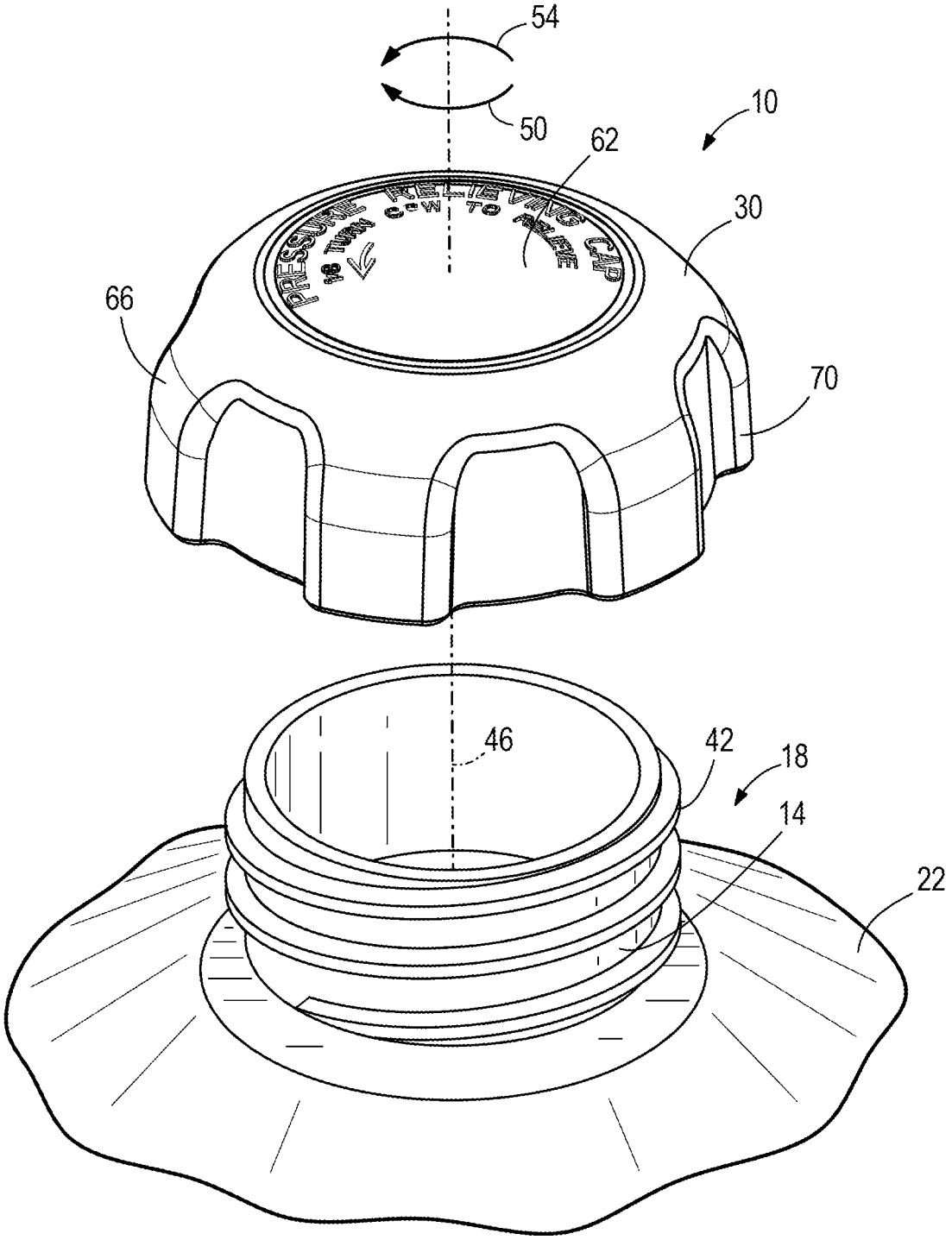
FIG. 1 is a perspective view illustrating a pressure relief cap.

FIG. 1 illustrates a pressure relief cap 10 that is removably couplable to an opening or inlet 14 of a container 18. When positioned on the inlet 14, the illustrated cap 10 blocks the inlet 14 to enclose the contents of the container 18. In some embodiments, the container 18 includes a fuel tank 22, such as a standalone fuel tank or a fuel tank incorporated into a vehicle or other powered machine. In other embodiments, the cap 10 can be used with any other container 18 storing any other contents.

The illustrated cap 10 includes a body 26 (FIG. 2) and a handle 30 coupled to the body 26. The body 26 has an annular wall 34 with internal threads 38 engageable with external threads 42 on the inlet 14 of the container 18 (FIG. 1) to couple the body 26 to the container 18. In an alternative construction (not shown), the body 26 may include external threads engageable with internal threads on the inlet 14. The body 26 is rotatable about an axis 46 in a tightening direction 50 and a loosening direction 54 to respectively couple and decouple the body 26 from the inlet 14.

Figure 2:
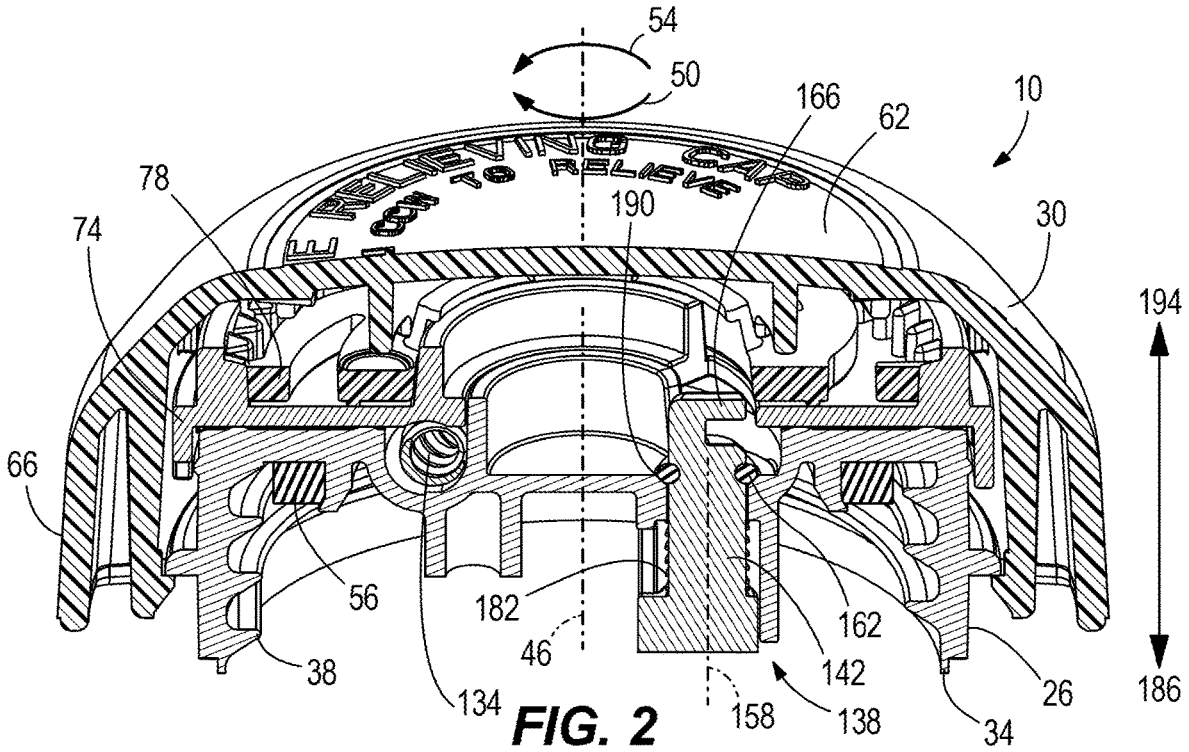
FIG. 2 is a cross-sectional view of the cap of FIG. 1, with a pressure relief valve assembly of the cap illustrated in a sealed state.
Figure 7:
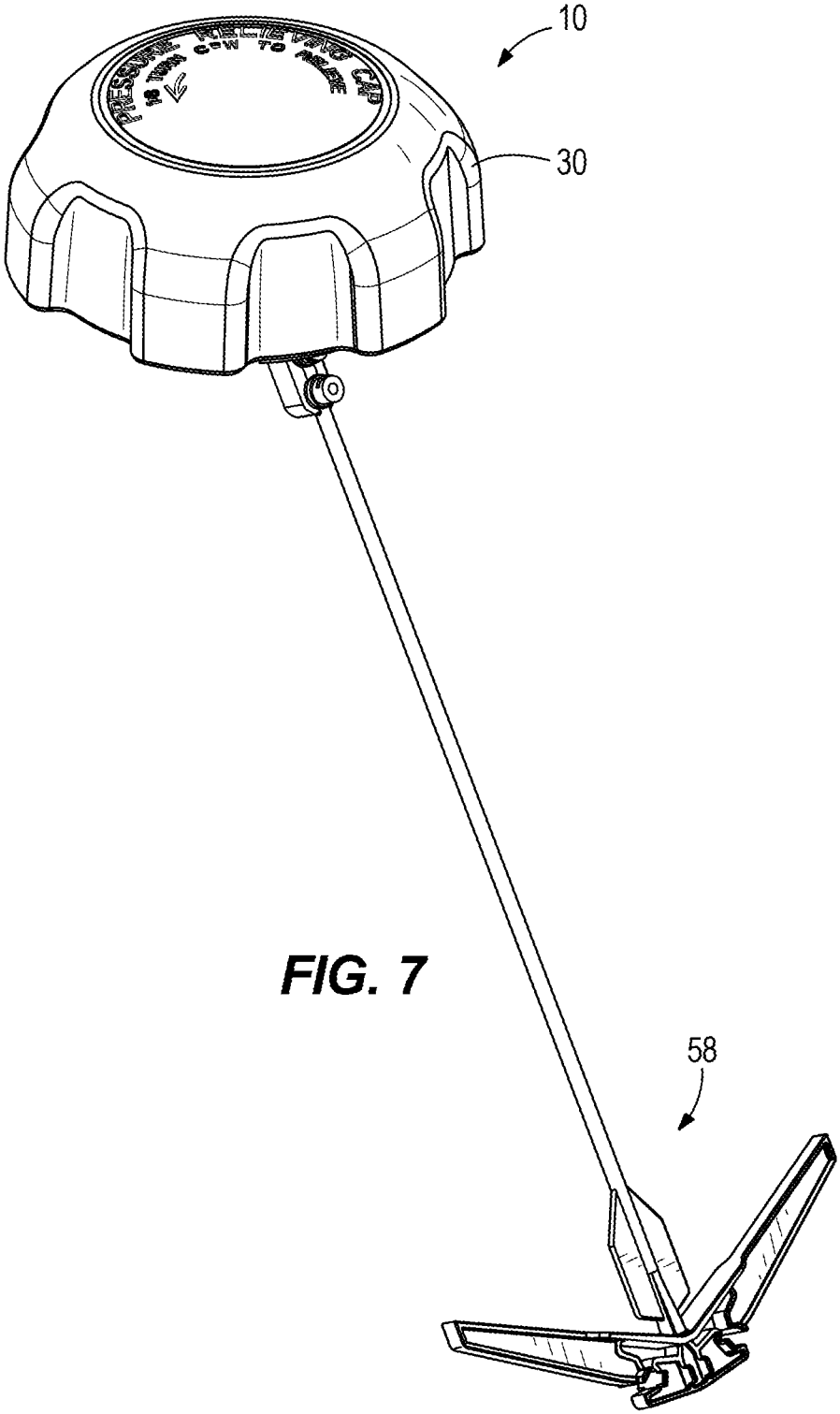
FIG. 7 is a perspective view of the pressure relief cap of FIG. 1 including a tether.

Referring to FIG. 2, the body 26 carries a gasket 56 that is surrounded by the annular wall 34. The gasket 56 is engageable with an outer edge of the inlet 14 to create a substantially liquid and/or gas-tight seal between the body 26 and the inlet 14 when the body 26 is coupled to the inlet 14. In some embodiments, a tether 58 (FIG. 7) may be provided to retain the cap 10 with the container 18 even when the body 26 is decoupled from the inlet 14. In such embodiments, the tether 58 may be coupled to the body 26 or the handle 30 of the cap 10.

In the illustrated embodiment, the handle 30 has a top side 62 and a circumferential side 66 extending downward from the top side 62. The illustrated circumferential side 66 has a plurality of ridges or undulations 70 (FIG. 1), which enhance a user's ability to grip and rotate the handle 30 (e.g., when tightening or loosening the cap).

Figure 4:
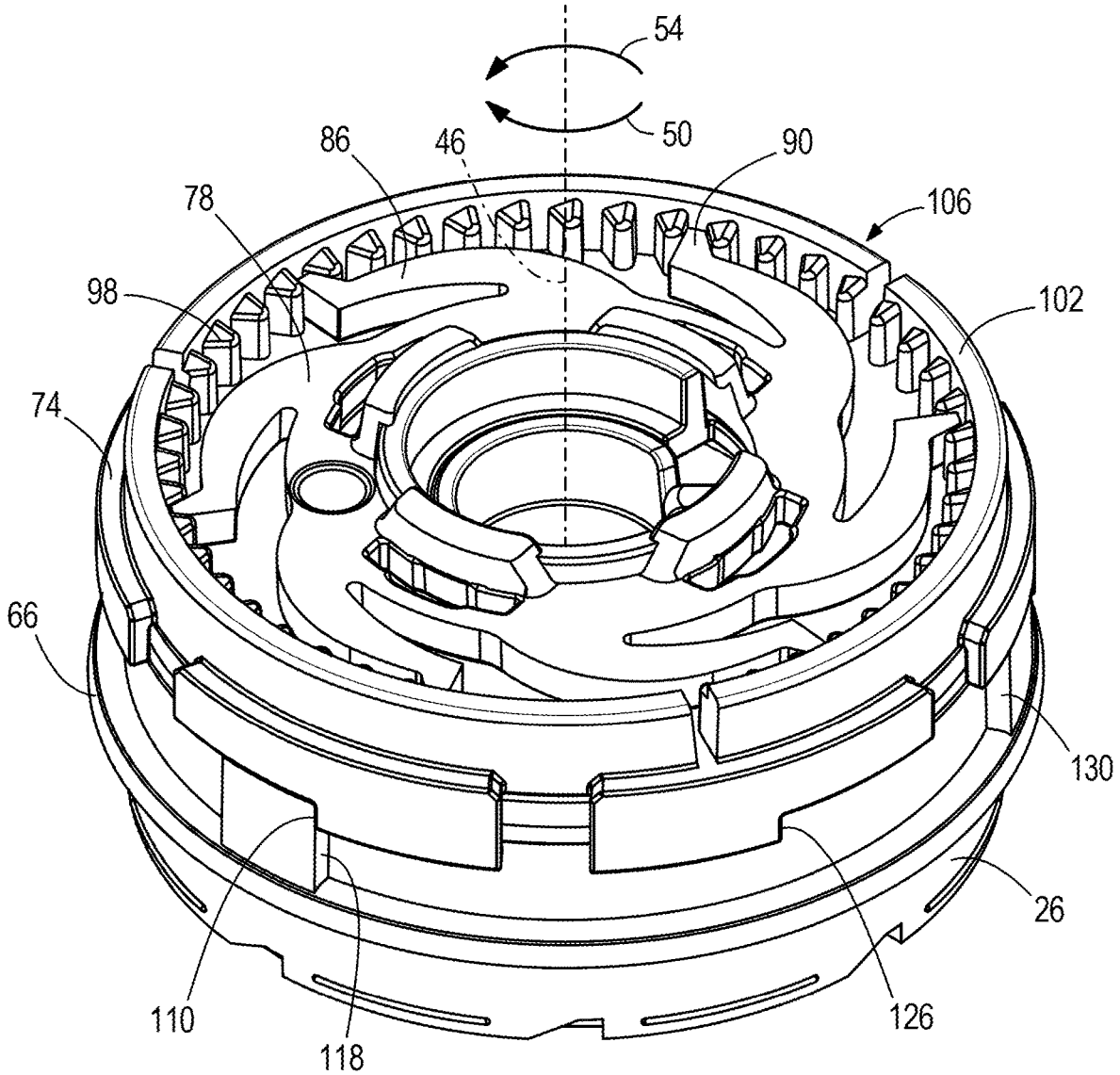
FIG. 4 is a perspective view illustrating a portion of the pressure relief cap of FIG. 1.
Figure 5:
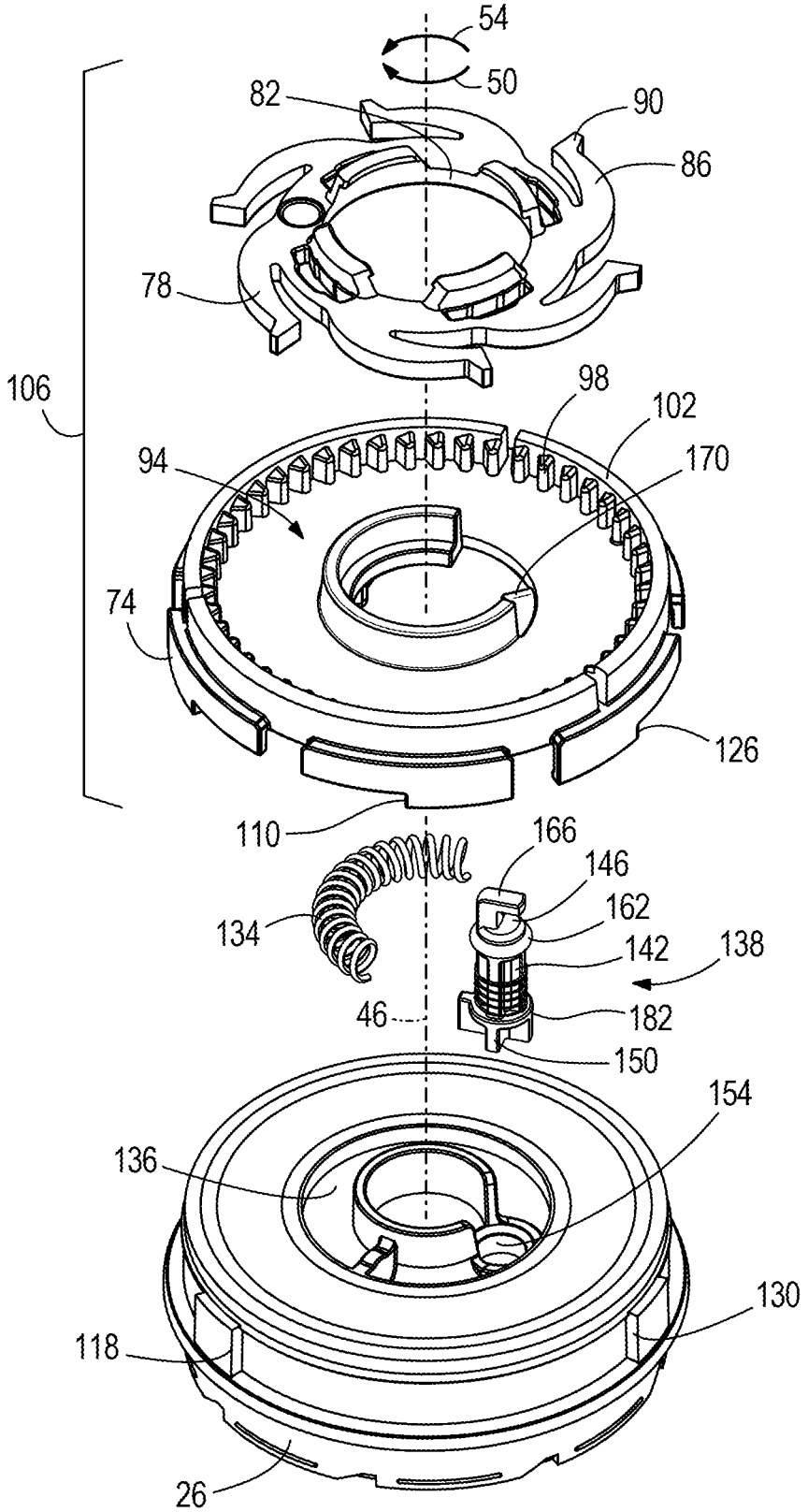
FIG. 5 is an exploded view of the portion of the pressure relief cap of FIG. 4.

The handle 30 is coupled to the body 26 via a ratchet 78 and a ring member 74 (FIGS. 4 and 5). As described in greater detail below, the ratchet 78 and the ring member 74 are configured to selectively couple the handle 30 and the body 26 for co-rotation and to selectively permit the handle 30 to rotate relative to the body 26.

Figure 3:
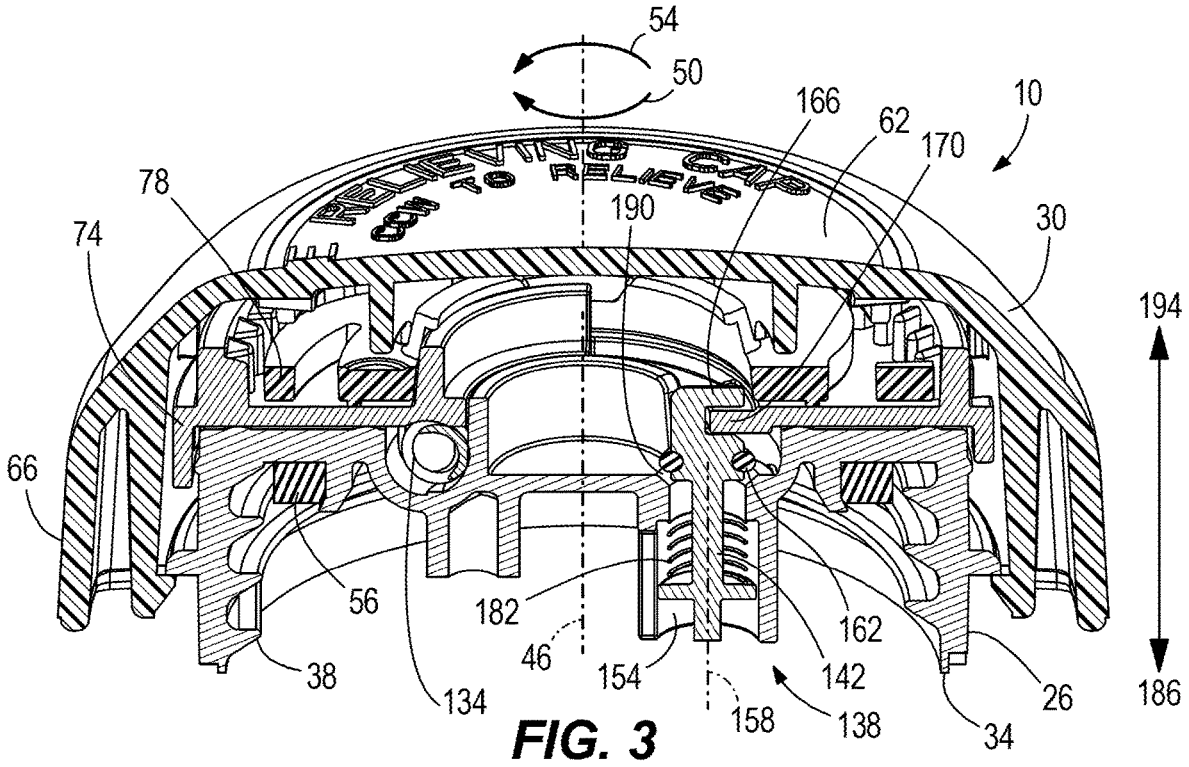
FIG. 3 is a cross-sectional view of the cap of FIG. 1, with the pressure relief valve assembly illustrated in an unsealed state.

The ratchet 78 is fixed inside of the handle 30 (e.g., via a snap fit), such that the ratchet 78 co-rotates with the handle 30 (FIGS. 2-3). The illustrated ratchet 78 includes an annular central hub 82 and a plurality of flexible arms 86 extending outward from the hub 82 (FIG. 5). Each of the flexible arms 86 terminates with a pawl 90. The ratchet 78 is received in an annular recess 94 on top of the ring member 74. The flexible arms 86 press the pawls 90 into engagement with ratchet teeth 98 that extend radially inwardly from an outer annular wall 102 of the ring member 74.

The ratchet 78 and the ring member 74 thus define a ratchet assembly 106 (FIG. 5) operable to limit the amount of torque that may be transferred from the ratchet 78 (and, therefore, from the handle 30) to the ring member 74. Once a predetermined torque threshold is reached (based at least in part on the constructions of the pawls 90, the ratchet teeth 98, the flexible arms 86, etc.), the pawls 90 slide away from the ratchet teeth 98 while the arms 86 bend inwardly.

In the illustrated embodiment, the ratchet assembly 106 only limits torque transfer in one rotational direction (e.g., the tightening direction 50). In some embodiments (not shown), the ratchet assembly 106 may be omitted, such that the handle 30 may be directly coupled to the ring member 74.

Referring to FIGS. 4-5, the ring member 74 is coupled to the body 26 for limited rotation relative to the body 26 about the axis 46. A first rib 110 is located on an outer periphery of the ring member 74, and a second rib 118 is located on an outer periphery of the body 26. The first rib 110 is engageable with the second rib 118 to cause the body 26 to co-rotate with the ring member 74 in the tightening direction 50.

The ring member 74 also includes a third rib 126 on the outer periphery of the ring member 74, offset in a circumferential direction from the first rib 110, and the body 26 includes a fourth rib 130 on the outer periphery of the body 26, offset in a circumferential direction from the second rib 118. The third rib 126 is engageable with the fourth rib 130 to cause the body 26 to co-rotate with the ring member 74 in the loosening direction 54.

In the illustrated embodiment, the spacing between the first and third ribs 110, 126 is less than the spacing between the second and fourth ribs 118, 130. Thus, a lost motion region is defined in the region between the second and fourth ribs 118, 130. That is, the ring member 74 is rotatable relative to the body 26 in either direction (e.g., FIG. 6B), until either the first rib 110 comes into engagement with the second rib 118 (FIGS. 4 and 6A) or the third rib 126 comes into engagement with the fourth rib 130, at which point the ring member 74 (and, thus, the handle 30) rotates the body 26.

In the illustrated embodiment, the lost motion region spans an angular distance of about 45 degrees. In other embodiments, the extent of the lost motion region may be varied based on the relative positions of the ribs 110, 118, 126, 130. Although only one set of ribs 110, 118, 126, 130 is described herein, the cap 10 may include multiple sets of ribs that engage and disengage simultaneously (e.g., to improve the strength of the torque-transmitting connection between the ring member 74 and the body 26).

With reference to FIG. 5, the cap 10 further includes a first biasing member 134 coupled between the ring member 74 and the body 26 to bias the ring member 74 relative to the body 26 (e.g., in the tightening direction 50) to define an initial position of the body 26 relative to the ring member 74. As such, the first rib 110 is biased into engagement with the second rib 118.

In the illustrated embodiment, the first biasing member 134 is a coil spring bent into an arc shape and accommodated within a toroidal pocket 136 in the body 26. In other embodiments (not shown), the first biasing member 134 may be a torsion spring or any other suitable means for biasing the ring member 74 relative to the body 26 in the tightening direction 50.

With continued reference to FIG. 5, the cap 10 further includes a relief valve assembly 138 coupled, in the illustrated construction, to the body 26. The illustrated valve assembly 138 includes a plunger 142 with an upper retaining portion 146 and a lower retaining portion 150. The plunger 142 is slidably received within a valve bore 154 extending through the body 26 along a valve axis 158 (FIGS. 2 and 3) parallel to the rotational axis 46 of the body 26. A peripheral seal 162 (e.g., an O-ring) is coupled to the upper retaining portion 146 of the plunger 142.

An arm 166 extends from the upper retaining portion 146 of the plunger 142 for engagement with a cam shaped actuator 170 disposed adjacent an inner periphery of the ring member 26. The arm 166 extends from the top of the plunger 142 in an L-shape. The actuator 170 is slidable underneath the arm 166 when the ring member 74 is rotated relative to the body 26 in the loosening direction 54, and this movement actuates the valve assembly 138, as described in greater detail below.

The valve assembly 138 includes a second biasing member 182 disposed between an underside of the body 26 surrounding the valve bore 154 and the lower retaining portion 150. The second biasing member 182 acts on the plunger 142 to bias the plunger 142 downwardly, in the direction of arrow 186, such that the peripheral seal 162 is biased into engagement with a seat 190 surrounding the valve bore 154 in the body 26 (FIGS. 2 and 3). When engaged with the seat 190, the peripheral seal 162 and the seat 190 create a substantially gas-tight seal.

In the illustrated embodiment, the second biasing member 182 is a coil spring, in other constructions (not shown), the second biasing member 182 may alternatively or additionally include, for example, magnets, a disc spring, or any other means for biasing the plunger 142.

The plunger 142 is axially movable along the valve axis 158 between a first position (FIG. 2), in which the peripheral seal 162 is engaged with the seat 190 to define a closed or sealed state of the valve assembly 138, and a second position (FIG. 3), in which the peripheral seal 162 is disengaged from the seat 190 to define an open or unsealed state of the valve assembly 138. The actuator 170 is engageable with the arm 166 to move the plunger 142 upwardly, in direction of arrow 194, towards the second position to open the valve assembly 138. That is, when the handle 30 is rotated in the loosening direction 54, the ring member 74 rotates relative to the body 26 through the lost motion region, and the actuator 170 to engages with the arm 166 to raise the plunger 142 and thereby open the valve assembly 138. As such, the illustrated valve assembly 138 is configured to relieve a pressure imbalance between the interior of the container 18 and the surrounding atmosphere before a user can loosen the cap 10 from the container 18.

Figure 6A:
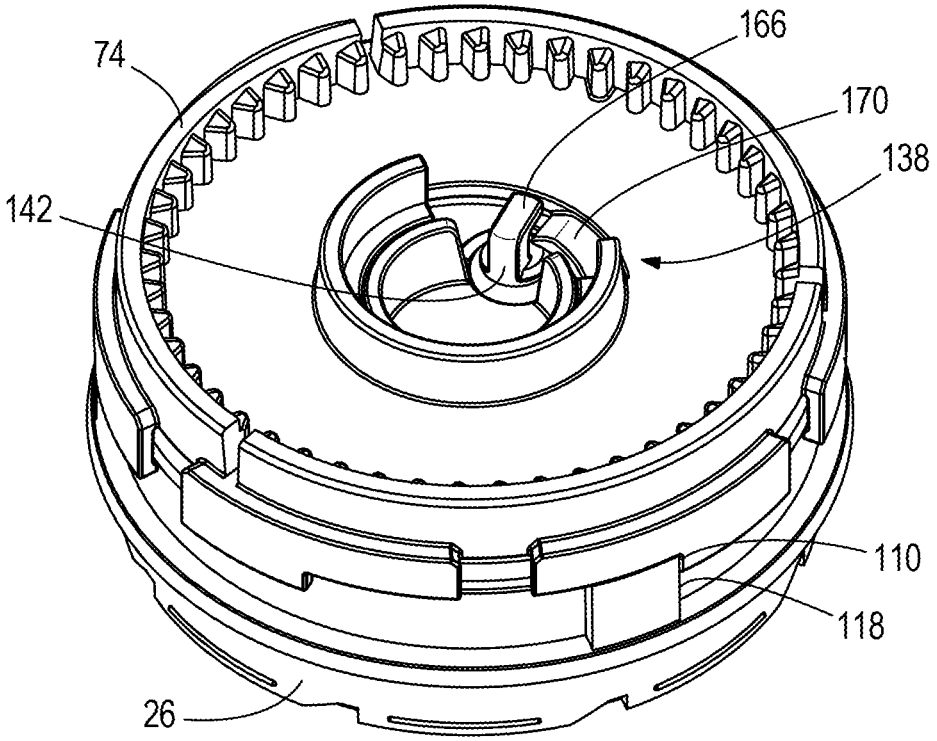
FIG. 6A is a perspective view of a portion of the pressure relief cap of FIG. 1, illustrating the pressure relief valve assembly in the sealed state.

In operation, to close the container 18, the user inserts the body 26 of the cap 10 into the inlet 14 and grasps and rotates the handle 30 in the tightening direction 50 (FIGS. 1-2). Torque is transferred from the handle 30, through the ratchet assembly 106 and to the body 26 via the engaged first rib 110 and the second rib 118 (FIGS. 4 and 6A). The body 26 can thus be threaded onto the threads of the inlet 14.

If torque applied to the handle 30 in the tightening direction 50 exceeds the torque threshold of the ratchet assembly 106, the arms 86 flex inwardly, and the pawls 90 ride over the associated ratchet teeth 98. As such, the handle 30 and the ratchet 78 rotate relative to the ring member 74 and the body 26, and the torque-transmitting connection between the handle 30 and the body 26 is at least momentarily disengaged. The ratchet assembly 106 may thus prevent over-tightening of the cap 10. In addition, when the pawls 90 ride over the ratchet teeth 98, the ratchet assembly 106 may provide audible and/or tactile feedback to the user that a sufficient level of torque (e.g., at or greater than a minimum retention torque) has been achieved.

Figure 6B:
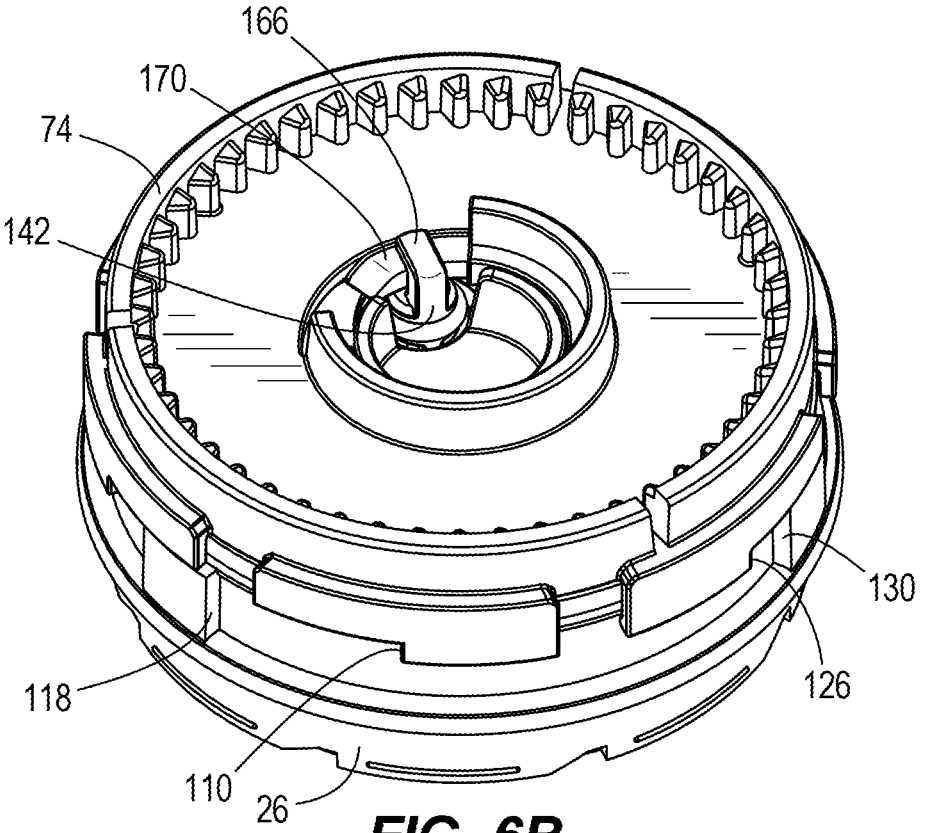
FIG. 6B is a perspective view of a portion of the pressure relief cap of FIG. 1, illustrating the pressure relief valve assembly in the unsealed state.

To remove the cap 10 and open the container 18, the user grasps and rotates the handle 30 in the loosening direction 54. Torque is transferred from the handle 30, through the ratchet 78, and to the ring member 74. The torque required to compress the first biasing member 134 is less than the torque required to overcome the friction between the gasket 56 on the body 26 and the inlet 14 of the container 18, along with the friction between the threads 38, 42. As such, initial rotation of the handle 30 in the loosening direction 54 disengages the first rib 110 and the second rib 118 to allow the ring member 74 to enter the lost motion region (FIG. 6B).

In the lost motion region, the ring member 74 rotates against the first biasing member 134 (FIG. 5), while the body 26 remains stationary. As the ring member 74 rotates, the actuator 170 slides underneath and bears upwardly against the arm 166 on the plunger 142. The actuator 170 thus moves the plunger 142 from the first position (FIG. 2), in which the peripheral seal 162 is engaged with the seat 190, toward the second position (FIG. 3) to open the valve assembly 138. Pressure can then be vented into or out of the container 18 through the valve bore 154 to equalize any imbalance between the interior of the container 18 and the surrounding atmosphere.

As the user continues to apply torque in the loosening direction 54, the ring member 74 reaches the end of the lost motion region, and the third rib 126 on the ring member 74 engages with the fourth rib 130 on the body 26 (e.g., a second position of the ring member relative to the body 26). Continued rotation of the handle 30 is then transferred to the body 26 to allow the body 26 to be unscrewed from the threads 42 of the inlet 14.

Thus, the handle 30 and the ring member 74 may be rotated together relative to the body 26 in the loosening direction 54 from a first or initial position (e.g., FIGS. 4 and 6A) to a second position (e.g., FIGS. 3 and 6B) to open the valve assembly 138, and the handle 30 and the ring member 74 may be further rotated in the loosening direction 54 from the second position to cause the body 26 to co-rotate with the handle 30 and the ring member 74 in the loosening direction.

Once the torque required to unscrew the body 26 from the inlet 14 reduces below the torque applied by the first biasing member 134 (e.g., when the gasket 56 is unseated from the inlet 14), the first biasing member 134 recovers and rotates the body 26 of the cap 10 relative to the handle 30 to the initial position of the body 26 in which the first rib 110 is engaged with the second rib 118. The relief valve assembly 138 closes under the influence of the second biasing member 182.

Because the gasket 56 is unseated, any pressure imbalance that may remain after initial venting through the relief valve assembly 138 can be equalized via flow between the threads 38, 42. The first biasing member 134 is stiff enough to cause the body 26 to co-rotate with the handle 30 as the user continues to rotate the handle 30 in the loosening direction 54, until the cap 10 is fully removed from the container 18.

Figure 8:
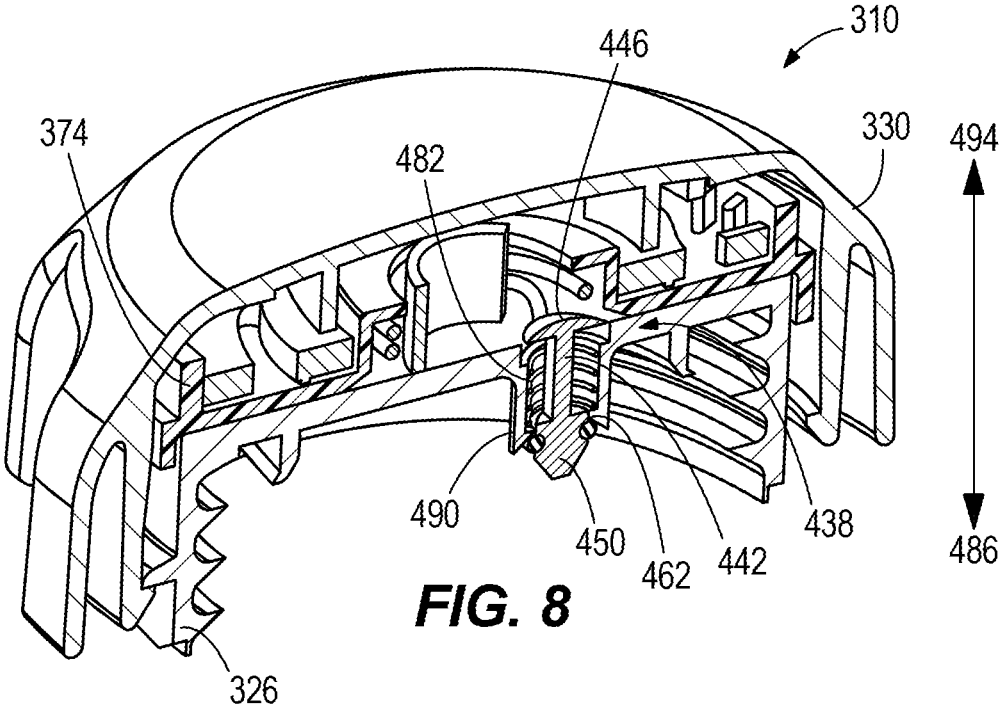
FIG. 8 is a cross-sectional view of an alternative construction of a pressure relief cap with a pressure relief valve assembly of the cap illustrated in a sealed state.
Figure 9:
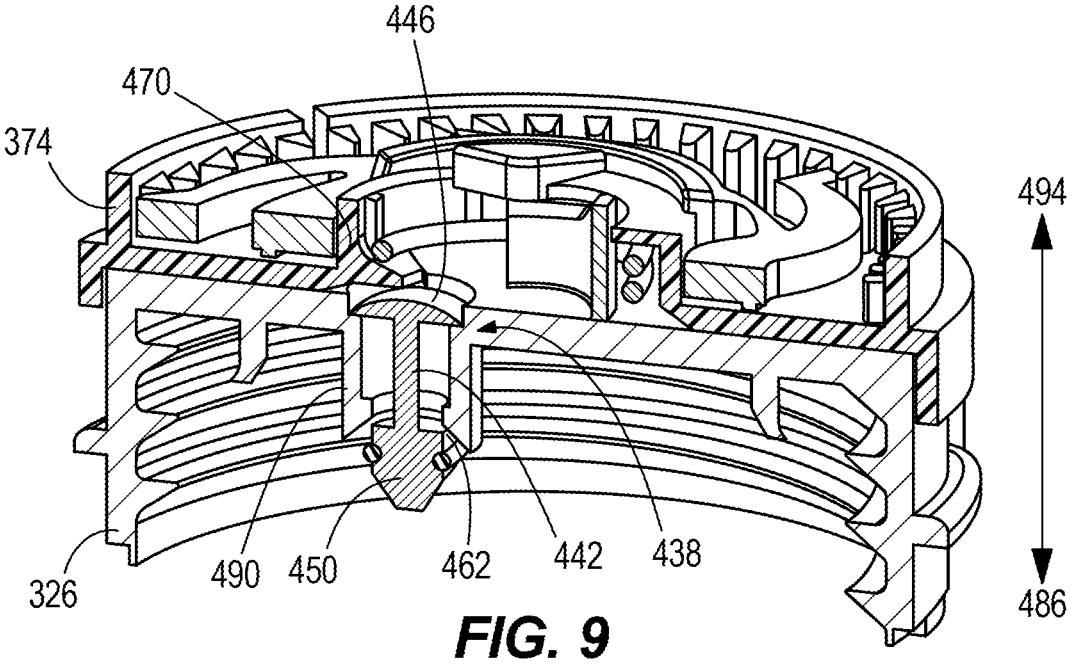
FIG. 9 is a cross-sectional view of the pressure relief cap of FIG. 8, with the pressure relief valve assembly illustrated in an unsealed state.

FIGS. 8-9 illustrate an alternative construction of a pressure relief cap 310. The cap 310 is similar to the pressure relief cap 10 described above with reference to FIGS. 1-7, and the following description focuses primarily on differences between the cap 310 and the cap 10. In addition, common features and elements of the pressure relief cap 310 corresponding with features and elements of the pressure relief cap 10 are given common reference numbers plus 300.

The cap 310 includes a body 326, a handle 330 (FIG. 8) coupled to the body 326 via a ring member 374, and a pressure relief valve assembly 438. The valve assembly 438 includes a plunger 442 that, instead of being biased downwardly like the plunger 142, is biased upwardly (i.e. in the direction of arrow 494 by the second biasing member 482).

The upper portion 446 of the plunger 442 is formed with a rounded engagement surface, and the peripheral seal 462 surrounds the lower portion 450. When rotated, the cam shaped actuator 470 on the ring member 374 is configured to press down in the direction of arrow 486 against the rounded engagement surface on the upper portion 446 of the plunger 442 (FIG. 9). This moves the plunger 442 downwardly to unseat the peripheral seal 462 from the valve seat 490 and thereby open the valve assembly 438.

Thus, the present disclosure may provide a pressure relief cap 10, 310 with a relief valve assembly 138, 438 configured to relieve pressure from a container 18 when rotated in a loosening direction 54, 354. The cap 10, 310 may also include a body 26, 326 and a ring member 74, 374 that allows for the valve assembly 138, 438 to be actuated before a driving connection to remove the cap 10, 310 is established between the handle 36, 336 and the body 26, 326.

Although the disclosure has been described in detail with reference to certain independent embodiments, variations and modifications exist within the scope and spirit of one or more independent aspects of the disclosure as described.

One or more independent features and/or advantages may be set forth in the following claims.

What is claimed is:

1. A pressure relief cap configured to be coupled to a container, the pressure relief cap comprising:

a body engageable with the container and rotatable about an axis to couple or decouple the body from the container, the body having a second rib and a fourth rib offset in a circumferential direction from the second rib;

a handle coupled to the body and rotatable about the axis in a loosening direction and a tightening direction;

a ring member coupled for co-rotation with the handle in the loosening direction, the ring member having a first rib and a third rib offset in a circumferential direction from the first rib; and a relief valve assembly coupled to the body;

wherein the ring member and the body are configured with a lost motion region defined between the second and fourth ribs in which the ring member is rotatable relative to the body in the loosening direction, wherein rotation of the ring member relative to the body in the loosening direction in the lost motion region opens the relief valve assembly;

wherein rotation of the ring member in the loosening direction disengages the first rib and the second rib to allow the ring member to enter the lost motion region, and wherein the third rib on the ring member engages with the fourth rib on the body when the ring member reaches the end of the lost motion region to allow the body to co-rotate with the ring member in the loosening direction.

2. The pressure relief cap of claim 1, further comprising a biasing member coupled between the body and the ring member, the biasing member being configured to bias the ring member relative to the body in the tightening direction.

3. The pressure relief cap of claim 2, wherein the biasing member is configured to bias the first rib into engagement with the second rib.

4. The pressure relief cap of claim 3, wherein engagement of the first rib with the second rib causes the body to co-rotate with the ring member in the tightening direction.

5. The pressure relief cap of claim 1, wherein a spacing between the first rib and the third rib is less than a spacing between the second rib and the fourth rib.

6. The pressure relief cap of claim 5, wherein a difference between the spacing between the first rib and the third rib and the spacing between the second rib and the fourth rib is about 45 degrees.

7. The pressure relief cap of claim 1, wherein the relief valve assembly includes a plunger and a second biasing member operable to bias the plunger toward a sealed position.

8. The pressure relief cap of claim 7, wherein the ring member includes a cam-shaped actuator configured to move the plunger toward an unsealed position when the ring member rotates relative to the body in the loosening direction through the lost motion region.

9. The pressure relief cap of claim 1, further comprising a ratchet assembly operable to permit the handle to rotate relative to the ring member in the tightening direction when torque applied to the handle in the tightening direction exceeds a predetermined threshold.

10. A pressure relief cap configured to be coupled to a container, the pressure relief cap comprising:

a body engageable with the container and rotatable about an axis, the body having a second rib and a fourth rib offset in a circumferential direction from the second rib;

a handle coupled to the body and rotatable about the axis in a loosening direction and a tightening direction;

a ring member coupled for co-rotation with the handle in the loosening direction, the ring member having a first rib and a third rib offset in a circumferential direction from the first rib; and a relief valve assembly coupled to the body, wherein the handle and the ring member are rotatable relative to the body in the loosening direction from a first position where the third rib is spaced from the fourth rib to a second position where the third rib engages the fourth rib, wherein the relief valve assembly is configured to open to vent the container in response to rotation of the handle and the ring member from the first position to the second position, and wherein the body is configured to rotate in the loosening direction in response to further rotation of the handle and the ring member from the second position in the loosening direction.

11. The pressure relief cap of claim 10, wherein the pressure relief cap includes a biasing member configured to bias the first rib into engagement with the second rib.

12. The pressure relief cap of claim 11, wherein engagement of the first rib with the second rib causes the body to co-rotate with the ring member in the tightening direction.

13. The pressure relief cap of claim 10, wherein a spacing between the first rib and the third rib is less than a spacing between the second rib and the fourth rib.

14. The pressure relief cap of claim 10, further comprising a ratchet assembly operable to permit the handle to rotate relative to the ring member in the tightening direction when torque applied to the handle in the tightening direction exceeds a predetermined torque threshold.

15. The pressure relief cap of claim 14, wherein the ratchet assembly includes a central hub and a flexible arm extending from the central hub, and the flexible arm terminates with a pawl.

16. The pressure relief cap of claim 15, wherein the ring member includes ratchet teeth that engage with the pawl, and wherein the flexible arm is configured to bend to slide away from the ratchet teeth in response to torque exceeding the predetermined torque threshold being applied to the handle in the tightening direction.

17. The pressure relief cap of claim 10, wherein the relief valve assembly includes a plunger biased toward a sealed position, and wherein the ring member includes a cam-shaped actuator configured to move the plunger toward an unsealed position to open the relief valve assembly.

18. A pressure relief cap configured to be coupled to a container, the pressure relief cap comprising:

a body engageable with the container and rotatable about a rotational axis extending centrally through the body;

a handle coupled to the body and rotatable about the rotational axis in a loosening direction and a tightening direction;

a ring member coupled for co-rotation with the handle in the loosening direction; and a relief valve assembly coupled to the body, the relief valve assembly having a plunger that is movable between a sealed position and an unsealed position along a valve axis that is offset from the rotational axis, wherein the handle and the ring member are rotatable relative to the body in the loosening direction from a first position to a second position, wherein the plunger is configured to move to the unsealed position to vent the container in response to rotation of the handle and the ring member from the first position to the second position, and wherein the body is configured to rotate in the loosening direction in response to further rotation of the handle and the ring member from the second position in the loosening direction.

19. The pressure relief cap of claim 18, wherein the valve axis is parallel to the rotational axis.

20. The pressure relief cap of claim 18, wherein the ring member includes a cam-shaped actuator configured to move the plunger toward the unsealed position to open the relief valve assembly.

* * * * *